United States Patent [19]

Vandenbussche

[11] 4,303,428

[45] Dec. 1, 1981

[54] CRYOGENIC PROCESSES FOR SEPARATING AIR

[75] Inventor: Gerard Vandenbussche, Fontenay-sous-Bois, France

[73] Assignee: L'Air Liquide, Societe Anonyme pour l'Etude et l'Exploitation des Procedes Georges Claude, Paris, France

[21] Appl. No.: 168,369

[22] Filed: Jul. 10, 1980

[30] Foreign Application Priority Data

Jul. 20, 1979 [FR] France ..... 79 18772

[51] Int. Cl.[3] ..... F25J 3/04

[52] U.S. Cl. ..... 62/13; 62/41; 62/38; 62/30

[58] Field of Search ..... 64/29, 41, 38, 30, 13–15

[56] References Cited

U.S. PATENT DOCUMENTS

| | | | |
|---|---|---|---|
| 2,520,862 | 8/1950 | Swearingen | 62/29 |
| 3,083,544 | 4/1963 | Jakob | 62/41 |
| 3,143,406 | 8/1964 | Becker | 62/41 |
| 3,214,925 | 11/1965 | Becker | 62/41 |
| 3,648,471 | 3/1972 | Basin et al. | 62/41 |

FOREIGN PATENT DOCUMENTS

| | | |
|---|---|---|
| 1148546 | 6/1957 | France . |
| 1250454 | 12/1960 | France . |
| 1433585 | 2/1966 | France . |
| 1479127 | 3/1967 | France . |
| 2320513 | 4/1977 | France . |

*Primary Examiner*—Norman Yudkoff
*Attorney, Agent, or Firm*—Young & Thompson

[57] ABSTRACT

This invention relates to cryogenic air separation processes. Liquid low-pressure oxygen is pumped to a high pressure and vaporized and heated in thermal exchange with a first high-pressure fluid, and a second intermediate-pressure fluid drawn off and expanded in a turbine. The invention is used in the production of oxygen under high pressure.

12 Claims, 2 Drawing Figures

CRYOGENIC PROCESSES FOR SEPARATING AIR

BACKGROUND OF THE INVENTION

The present invention relates to cryogenic processes and plant for separation of air with production of oxygen under high pressure.

Conventionally, the production of oxygen under high pressure, meaning for example about 40 bars in the present context, is performed by simple compression of oxygen in the gaseous state suppplied by the low-pressure downflow section of a cryogenic air separation plant comprising a medium-pressure upstream section and a low-pressure downstream section. This compression of oxygen in the gaseous state is troublesome and the compression equipment is delicate and possibly unsafe or dangerous.

It has also been proposed to produce oxygen at the outflow from the low-pressure downstream section in the form of a fraction in the liquid state under low pressure, which is pumped to the high pressure from the said low pressure in the liquid state and which is exposed to a complete vaporization by thermal exchange in counterflow with fluids, of which the one or first fluid is air under a high pressure of the order of the said high pressure as hereinabove referred to, and a part of which is expanded to the medium pressure aforesaid before being fed, in at least partly liquid form, into at least one separation section, and the other or second fluid of which is air under an intermediate pressure, and fed in the gaseous state into the said separation section.

Compared to the first process referred to above, this process offers the advantage of obviating the use of an oxygen compressor, but has the drawback of leading to a higher overall power consumption as soon as a high oxygen production pressure prevails. This second process cannot be acceptable in respect of energy demand unless the oxygen vapourisation temperature remains below that of the high-pressure air condensing in counterflow with the vapourisation of this oxygen. Because of this, as moderate an oxygen pressure as 15–20 bars requires an air pressure already reaching 50–60 bars. The oxygen pressure lies between 40 and 100 bars for many applications, so that the condition specified above can no longer be fulfilled, the equipment utilised and in particular the exchangers, not rendering it possible to raise the air pressure substantially above these pressure levels.

It is an object of the invention to provide a process which economically renders it possible to obtain oxygen under high pressure by compression of an oxygen fraction in the liquid state.

SUMMARY OF THE INVENTION

Accordingly, in a cryogenic process for separating air with the production of oxygen under high pressure, of the kind in which air is separated in a cryogenic separation section comprising a medium-pressure upstream section and a low-pressure downstream section into at least one fraction rich in nigrogen and into at least one fraction rich in oxygen in the liquid state under low pressure, in which the said oxygen fraction is pumped in the liquid state from the said low pressure to the said high pressure, the said liquid oxygen fraction under high pressure being exposed to total vaporization by heat exchange in counterflow with fluids one of which is a first fluid which comprises at least one of the two principal components of air, and during the said exchange is under a high pressure of the order of the said high pressure, and is then expanded to the said medium pressure before being fed in an at least partially liquid state into at least one separation section, and the other of which is a second fluid comprising air under an intermediate pressure greater than said medium pressure but also lower than said high pressure, and is fed in the gaseous state into said upstream separation section, the invention consists in that an expansion of said second fluid to said medium pressure is carried out in turbine means at an intermediate temperature between the hot and cold temperatures of said heat exchange.

In a first embodiment, the first fluid under high pressure is actually air, and in a second embodiment, this first fluid under high pressure is nitrogen in a closed cycle. The intermediate pressure of the second fluid is comprised between 8 and 20 bars and is preferably of the order of 15 bars, whereas the high pressure of the oxygen is comprised between 15 and 100 bars and is preferably of the order of 40 to 65 bars.

BRIEF DESCRIPTION OF THE DRAWINGS

In order that the invention may be more clearly understood, reference will now be made to the accompanying drawings, by way of example in which certain embodiments thereof are shown and in which.

DETAILED DESCRIPTION OF PREFERRED EMBODIMENTS

Figure 1:
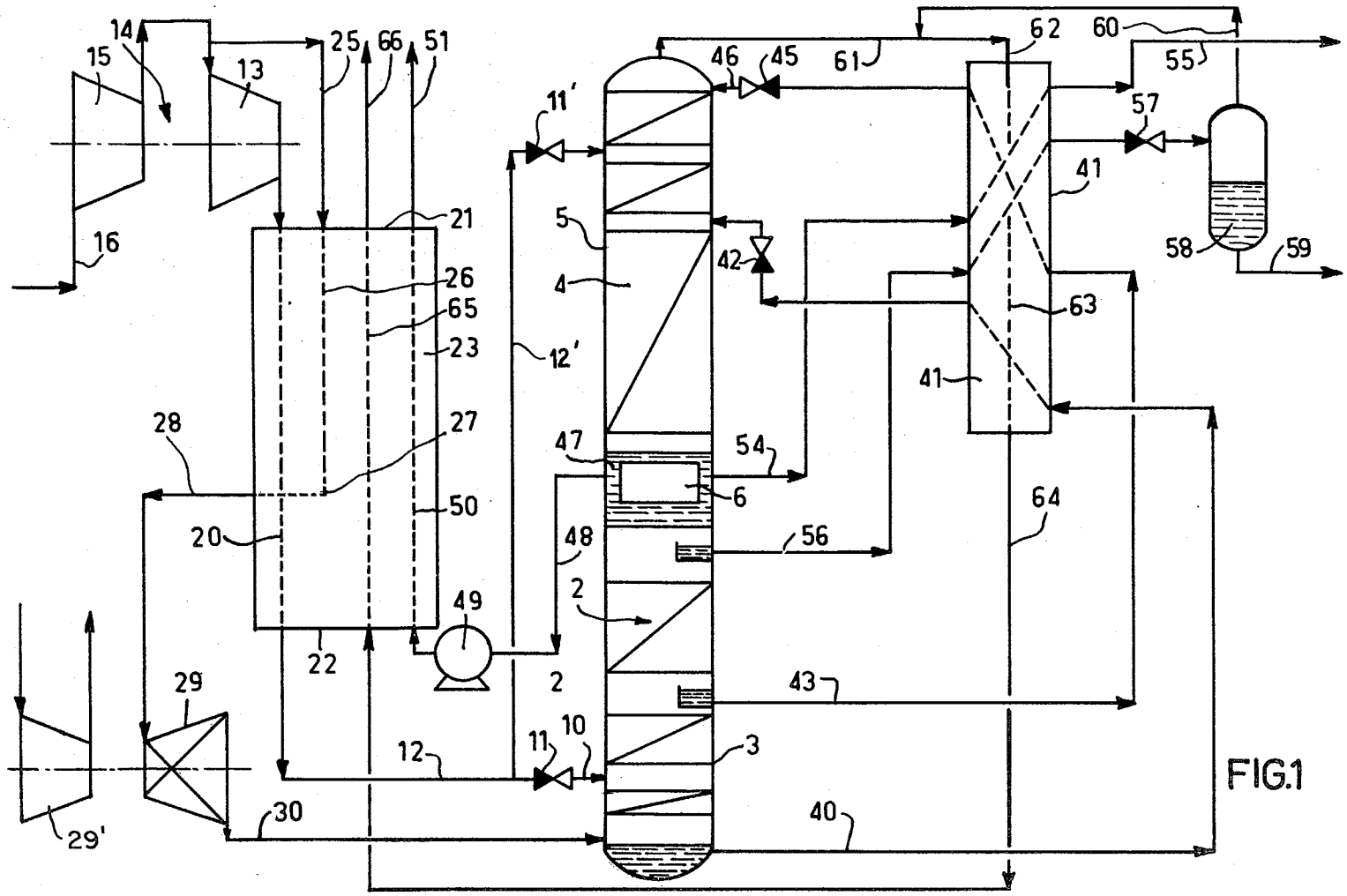
FIG. 1 illustrates a diagrammatic view of an air separation plant in accordance with the invention and FIG. 2 is a view analogous to that of FIG. 1, of a second embodiment.

Referring now to the drawings and firstly to FIG. 1, a cryogenic air separation plant as shown therein comprises an upstream separation section 2 formed by a "medium pressure" column 3 and a downstream separation section 4 formed by a "low-pressure" column 5, superposed on the column 3 with the interposition of a vapouriser-condenser 6. The medium-pressure column 3 is supplied with air which is to be separated under medium pressure, for example of the order of 6 bars, via a pipe 10 connected to the outlet of an expander 11 having an inlet which is supplied with air under atmospheric pressure. For example, the first compression stage 15 compresses the super-atmospheric air to a pressure of the order of 15 bars, whereas the second compression stage provides a final compression of 15 to 50 bars. The duct 12 carrying the air at 50 bars comprises heat exchange passages 20 extending from a hot extremity 21 to a coolest extremity 22 of an exchanger 23. It will be observed that a part of the air in the duct 12 is drawn off at 12' and, after expansion in 11' to the low pressure, is fed into the low-pressure column 5.

A part of the air compressed at the outlet from the compression stage 15 is drawn off via a pipe 25 towards passages 26 extending in the exchanger 23 from a hot extremity 21 to a level 27 situated at a distance from both the hot extremity 21 and the cold extremity 22, thus at an intermediate temperature between the higher temperature of the extremity 21 and the lower temperature of the extremity 22. These heat exchange passages 26 lead into a transfer pipe 28 feeding an expansion turbine 29 braked by a mechanism 29', the outlet of this turbine 29 being in communication with a pipe 30 leading direct to a low level of the medium pressure column 3.

In conventional manner, the fraction rich in oxygen condensed within the medium-pressure column 3 is transferred via a pipe 40, if applicable after subcooling in an exchanger 41 to an expander device 42 before being fed at an intermediate level into the low-pressure column 4. Analogously, liquid poor in oxygen which essentially comprises nitrogen, is tapped off at an intermediate level of the medium-pressure column and is transferred via a pipe 43 to the sub-cooling exchanger 41 before being expanded in the expander device 45 and fed at 46 into the top of the low-pressure column.

In the sump of the low-pressure column is formed a liquid oxygen fraction 47, a principal part of which is drawn off in a pipe 48 so that it may be pumped to a high pressure by a pump 49 before being fed into heat exchanger passages 50 extending from the cold extremity 22 to the hot extremity 21 of the exchanger 23, these passages 50 being in communication at the outlet with a pipe 51 for distribution of gaseous oxygen under high pressure.

Another part of the liquid oxygen fraction having a lesser flow rate is drawn off via a pipe 54 to the auxilliary cooling exchanger 41, for transfer via a pipe 55 to a store of sub-cooled liquid oxygen which is not illustrated.

It will be noted that a fraction of liquid nitrogen is drawn off at the top of the medium-pressure column 3 via a pipe 56 in order to be sub-cooled in the exchanger 41 before being expanded in an expander device 57 and reaching a separator 58 comprising a pipe 59 for withdrawal from the sump for a liquid fraction, and a pipe 60 for withdrawal from the top, for a gaseous fraction.

This pipe 60 for the gaseous fraction is connected moreover to a pipe 61 for gaseous nitrogen emerging at the top of the low-pressure column to form a common gas duct 62 leading to heating passages 63 in the subcooling exchanger 41, the outlet of these passages 63 being communication via a pipe 64 with heating passages 65 extending throughout the length of the exchanger 23 to effect the recombination in an output pipe 66 of impure nitrogen in the gaseous state and under low pressure.

The plant which has been described is operated as follows:

The air compressed successively in stage 15 and stage 13 under high pressure, by being fed into the passages 20 of the exchanger 23 essentially assures the heating with vapourisation of the liquid oxygen fed into the passages 50 and the final heating of the impure nitrogen fed into the passages 65. By constrast, the air under intermediate pressure obtained directly at the outlet of the compression stage 15 and fed into the cooling passages 26 escapes from the exchanger 23 at a temperature which is not too low and which, allowing for the comparatively low intermediate pressure to which this air had previously been raised, assures the keeping in the cold state of the cryogenic separation plant thanks to the expansion in the turbine 29 whilst keeping said air under the gaseous state essential for correct mechanical stability of the turbine 29.

By way of example, the results are collated below which were obtained with a total air flow of 1,000 $Nm^3$, a pressure of 50 bars at the outlet of the second compressure stage 15, an intermediate pressure at the outlet of the first compression stage 13 of, successively, 10, 12 and 15 bars, the flow of oxygen vapourised always being at 40 bars:

| Intermediate pressure (outlet stage 15) | 10 bars | 12 bars | 15 bars |
|---|---|---|---|
| Turbine inlet temperature (29) | −123° C. | −123° C. | −134° C. |
| Oxygen production under 40 bars | 196 $Nm^3$ | 191 $Nm^3$ | 185 $Nm^3$ |
| Air flow at 50 bars ($Nm^3$) | 426 $Nm^3$ | 374 $Nm^3$ | 301 $Nm^3$ |
| Liquid oxygen production (via 54) | 14 $Nm^3$ | 19 $Nm^3$ | 25 $Nm^3$ |
| Specific energy of the gaseous oxygen compressed to 40 bars | 105% | 102% | 100.7% |

The reference value (100%) is that obtained for oxygen at 40 bars, produced at atmospheric pressure with an apparatus of conventional kind and then compressed by a turbocompressor.

It will be understood that the values of the table (105; 102; 100.7%) make allowance for a deduction from the power consumption of the apparatus from that corresponding to the liquefaction of the oxygen part produced in the liquid state (14; 19; 25 $Nm^3$).

An intermediate pressure exceeding 15 bars has not been contemplated in this case, since it results in the appearance of a liquid phase in the turbine.

Taking into account no more than the specific energy of the oxygen at 40 bars, this imposes the selection of the highest value prior to the appearance of liquid in the turbine as the intermediate pressure, or 15 bars in this case. However, the selection is justified only if use is made of all the liquid produced (25 $Nm^3$) in this case, given that this liquid has been taken into account for calculation of the specific energy. If the requirements for liquid amount to no more than 19 $Nm^3$, an intermediate pressure of 12 bars only will have to be selected.

Figure 2:
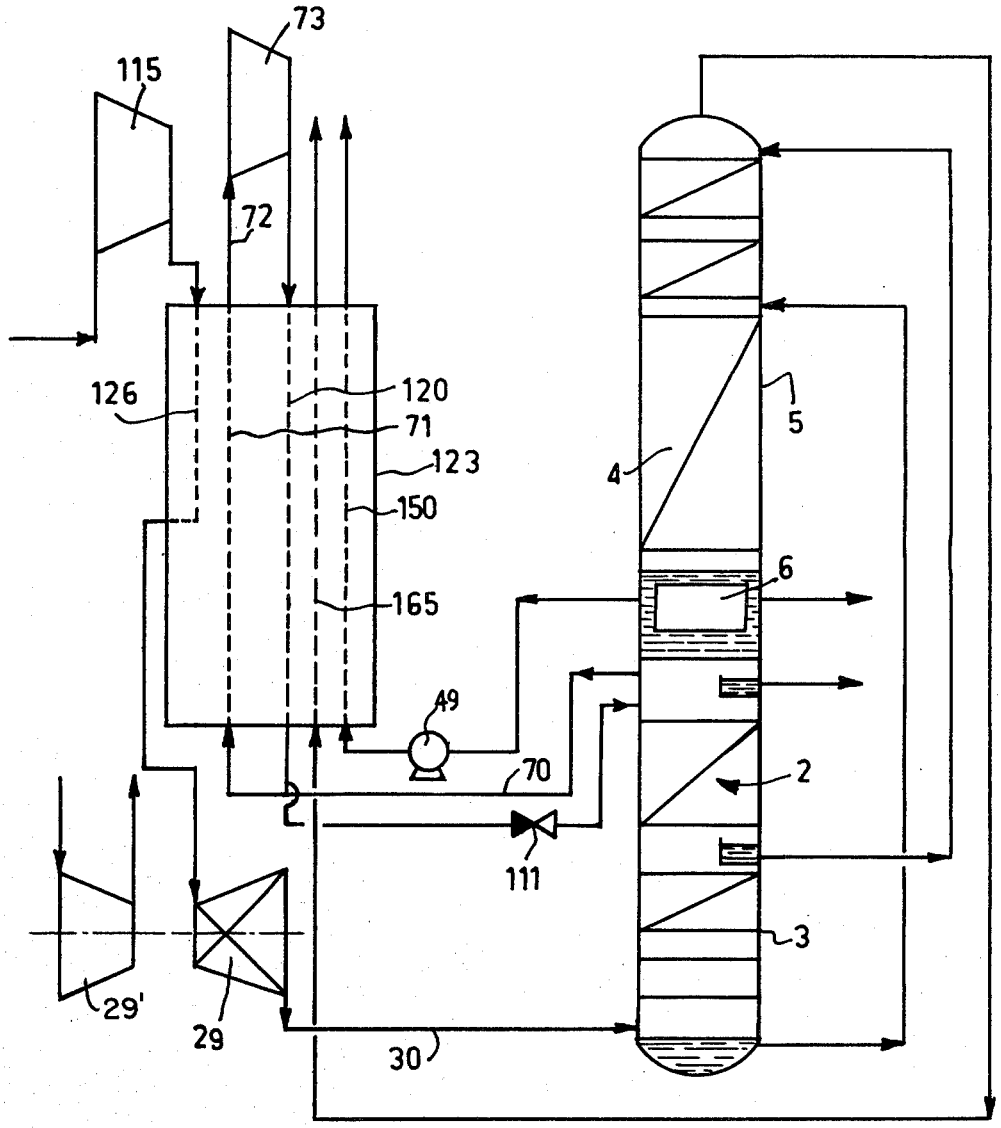

An embodiment in which an auxiliary nitrogen cycle is utilised is described with reference to FIG. 2. A separation plant having a medium-pressure column 3 and a low-pressure column 5 is also utilised in this embodiment. The plant also comprises, in the exchanger 123 (of the same kind as the exchanger 23 of FIG. 1), heating passages 150 with vapourisation of liquid oxygen (analogous to the passages 50 of FIG. 1), passages for heating impure nitrogen 165 (analogous to the passages 65 of FIG. 1), passages 120 for cooling a first fluid under high pressure (analogous to the passages 20 of FIG. 1), and cooling passages 126 for a second fluid which is again air under intermediate pressure, analogous to the passages 26 of FIG. 1.

In this case, the first fluid is no longer air as in FIG. 1, but nitrogen which is drawn off at a medium pressure at the top of the medium-pressure column 3 via a pipe 70 in order to be fed into complementary passages 71 of the exchanger 123, and then ducted via a pipe 72 to a compressor 73 raising the nitrogen pressure from the medium pressure (for example 6 bars) to the high pressure (for example 50 bars). The nitrogen thus compressed flows into the passages 120 of the exchanger 123, and is then expanded in the expander device 111 in order to be fed in again at the top of the mediumpressure column 3. By contrast, the entire flow of air which is to be separated is compressed in this case by the compressor 115 before entering the passages 126, the expansion turbine 29 and, via the pipe 30, passing into the sump of the medium-pressure column 3.

I claim:

1. In a cryogenic process for separating air with the production of oxygen under high pressure, of the kind in which air is separated in a cryogenic separation apparatus comprising a medium-pressure upstream section and a low-pressure downstream section into at least one fraction rich in nitrogen and into at least one fraction rich in oxygen in the liquid state under low pressure, in which the said oxygen fraction is pumped in the liquid state from the said low pressure to the said high pressure, the said liquid oxygen fraction under high pressure being exposed to total vaporization by heat exchange in counterflow with fluids one of which is a first fluid which comprises at least one of the two principal components of air, and during the said exchange is under a high pressure of the order of the said high pressure, and is then expanded to the said medium pressure before being fed in an at least partially liquid state into at least one said separation section, and the other of which is a second fluid comprising air under an intermediate pressure greater than said medium pressure but also lower than said high pressure, and is fed in the gaseous state into said upstream separation section; the improvement in which an expansion of all of said second fluid to said medium pressure is carried out in turbine means at an intermediate temperature between the hot and cold temperature of said heat exchange.

2. A process according to claim 1, wherein, after expansion, said first fluid is fed into said separation section under medium pressure.

3. A process according to claim 2, wherein said high pressure of said first fluid is substantially greater than said high oxygen pressure.

4. A process according to claim 2, wherein said high pressure of said first fluid is substantially lower than said high oxygen pressure.

5. A process according to claim 1, wherein said high pressure of said first fluid is substantially greater than said high oxygen pressure.

6. A process according to claim 1, wherein said high pressure of said first fluid is substantially lower than said high oxygen pressure.

7. A process according to claim 1, wherein said first fluid is air.

8. A process according to claim 1, wherein said first fluid is nitrogen.

9. A process according to claim 1, wherein said intermediate pressure is 8 to 20 bars.

10. A process according to claim 1, wherein said intermediate pressure is about 15 bars.

11. A process according to claim 1, wherein said high pressure is 15 to 100 bars.

12. A process according to claim 1, wherein said high pressure is 40 to 65 bars.

* * * * *